US005697616A

United States Patent [19]

Wilyard

[11] Patent Number: 5,697,616

[45] Date of Patent: Dec. 16, 1997

[54] APPARATUS AND METHOD OF PLAYING A TWO FACED POKER CARD GAME

[76] Inventor: Vincent Allen Wilyard, 6838 Neckel St., Dearborn, Mich. 48126-1839

[21] Appl. No.: 804,468

[22] Filed: Feb. 21, 1997

[51] Int. Cl.[6] ..... A63F 1/00

[52] U.S. Cl. ..... 273/303; 273/292; 273/304; D21/44; D21/43

[58] Field of Search ..... 273/303–305, 273/307, 308, 293, 292, 299–302; D21/44, 45, 43, 42, 46

[56] References Cited

U.S. PATENT DOCUMENTS

| | | | |
|---|---|---|---|
| D. 45,449 | 3/1914 | Down | D21/45 |
| D. 91,004 | 11/1933 | Crompton | D21/45 |
| D. 212,239 | 9/1968 | Schick | D21/45 |
| 712,556 | 11/1902 | Moller | 273/304 |
| 718,917 | 1/1903 | Coxe | 273/298 |
| 5,280,916 | 1/1994 | Gleason, Jr. | 273/304 |
| 5,549,301 | 8/1996 | Gerrard | 273/305 |

*Primary Examiner*—Benjamin H. Layno

[57] ABSTRACT

A two faced poker card game including a plurality of rectangular cards each with a top face, a bottom face, and a periphery. Each bottom face includes a first indicia including one of two different characters. Further printed on each bottom face is a second indicia including one of five different characters. Finally, a third indicia is printed on the bottom face including one of 14 different characters. During play, upon each player being dealt a predetermined amount of cards, a plurality of different combinations of various predetermined rankings may be formed from the cards by selectively utilizing the first, second and third indicia thereof.

4 Claims, 4 Drawing Sheets

| 26 | 28 | 30 | | | | | | | | | | | | |
|---|---|---|---|---|---|---|---|---|---|---|---|---|---|---|
| STAR | I | U | 2 | 3 | 4 | 5 | 6 | 7 | 8 | 9 | S | A | W | E | P |
| TREE | II | 3 | 4 | 5 | 6 | 7 | 8 | 9 | S | A | W | E | P | U | 2 |
| STAR | II | U | 2 | 3 | 4 | 5 | 6 | 7 | 8 | 9 | S | A | W | E | P |
| TREE | IV | 4 | 5 | 6 | 7 | 8 | 9 | S | A | W | E | P | U | 2 | 3 |
| STAR | III | U | 2 | 3 | 4 | 5 | 6 | 7 | 8 | 9 | S | A | W | E | P |
| TREE | V | 5 | 6 | 7 | 8 | 9 | S | A | W | E | P | U | 2 | 3 | 4 |
| STAR | IV | U | 2 | 3 | 4 | 5 | 6 | 7 | 8 | 9 | S | A | W | E | P |
| TREE | III | 6 | 7 | 8 | 9 | S | A | W | E | P | U | 2 | 3 | 4 | 5 |
| STAR | V | U | 2 | 3 | 4 | 5 | 6 | 7 | 8 | 9 | S | A | W | E | P |
| TREE | I | 7 | 8 | 9 | S | A | W | E | P | U | 2 | 3 | 4 | 5 | 6 |

APPARATUS AND METHOD OF PLAYING A TWO FACED POKER CARD GAME

BACKGROUND OF THE INVENTION

1. Field of the Invention

The present invention relates to a two faced poker card game and more particularly pertains to providing an increased number of ranked combinations and further affording a player an increased selection of combinations during each play.

2. Description of the Prior Art

The use of card games is known in the prior art. More specifically, card games heretofore devised and utilized for the purpose of entertaining users are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,382,025 to Sklansky discloses a method for playing a poker game.

U.S. Pat. No. 4,836,553 to Suttle et al discloses a poker game.

U.S. Pat. No. Des. 269,447 to Reheb discloses a deck of playing cards.

U.S. Pat. No. Des. 287,147 to Clapp discloses a deck of playing cards.

U.S. Pat. No. Des. 248,252 to Talley et al discloses a deck of playing cards.

U.S. Pat. No. 5,308,065 to Bridgeman et al. discloses a draw poker with random wild-card determination.

While these devices fulfill their respective, particular objective and requirements, the aforementioned patents do not describe a two faced poker card game for providing a challenging card game for users.

In this respect, the two faced poker card game according to the present invention substantially departs from the conventional concepts and designs of the prior art, and in doing so provides an apparatus primarily developed for the purpose of providing an increased number of ranked combinations and further affording a player an increased selection of combinations during each play.

Therefore, it can be appreciated that there exists a continuing need for new and improved two faced poker card game which can be used for providing a challenging card game for users. In this regard, the present invention substantially fulfills this need.

SUMMARY OF THE INVENTION

In the view of the foregoing disadvantages inherent in the known types of card games now present in the prior art, the present invention provides an improved two faced poker card game. As such, the general purpose of the present invention, which will be described subsequently in greater detail, is to provide a new and improved two faced poker card game and method which has all the advantages of the prior art and none of the disadvantages.

To attain this, the present invention essentially comprises a total of 70 rectangular cards each with a top face, a bottom face, and a periphery defined by a pair of short edges and a pair of long edges. Each top face has a decorative pattern formed thereon, as shown in FIG. 7. Each bottom face has a first section and a second section defined by a subdividing line extending between a center of the long edges. As shown in FIGS. 1–6, each section of each card includes a first indicia situated in a central extent and diagonal corners thereof. As shown in each of the Figures, the first indicia of the first section of each card is dissimilar to the first indicia of the second section. It should be noted that the first indicia includes one of two different characters. Further printed on each section of each card is a second indicia. Similar to the first indicia, the second indicia is situated in a central extent and diagonal corners thereof. The second indicia of the first section of each card is dissimilar to the second indicia of the second section. The second indicia includes one of five different characters. Finally, a third indicia is situated in a central extent and diagonal corners of each section of each card. The third indicia of the first section of each card is dissimilar to the third indicia of the second section. It should be noted that the third indicia includes one of 14 different characters. During play, upon each player being dealt predetermined amount of cards, a plurality of different combinations of various predetermined rankings may be formed from the cards by selectively utilizing the first, second and third indicia of only one of the sections thereof. A winning player is defined as the player having the combination with the highest predetermined rank.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved two faced poker card game which has all the advantages of the prior art card games and none of the disadvantages.

It is another object of the present invention to provide a new and improved two faced poker card game which may be easily and efficiently manufactured and marketed.

It is a further object of the present invention to provide a new and improved two faced poker card game which is of durable and reliable construction.

An even further object of the present invention is to provide a new and improved two faced poker card game which is susceptible of a low cost of manufacture with regard to both materials and labor, and which accordingly is then susceptible of low prices of sale to the consuming public, thereby making such a two faced poker card game economically available to the buying public.

Even still another object of the present invention is to provide a new and improved two faced poker card game for providing an increased number of ranked combinations of cards and further affording a player an increased selection of combinations during each play.

Lastly, it is an object of the present invention to provide a two faced poker card game including a plurality of rectangular cards each with a top face, a bottom face, and a periphery. Each bottom face includes a first indicia including one of two different characters. Further printed on each bottom face is a second indicia including one of five different characters. Finally, a third indicia is printed on the bottom face including one of 14 different characters. During play, upon each player being dealt a predetermined amount of cards, a plurality of different combinations of various predetermined rankings may be formed from the cards by selectively utilizing the first, second and third indicia thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
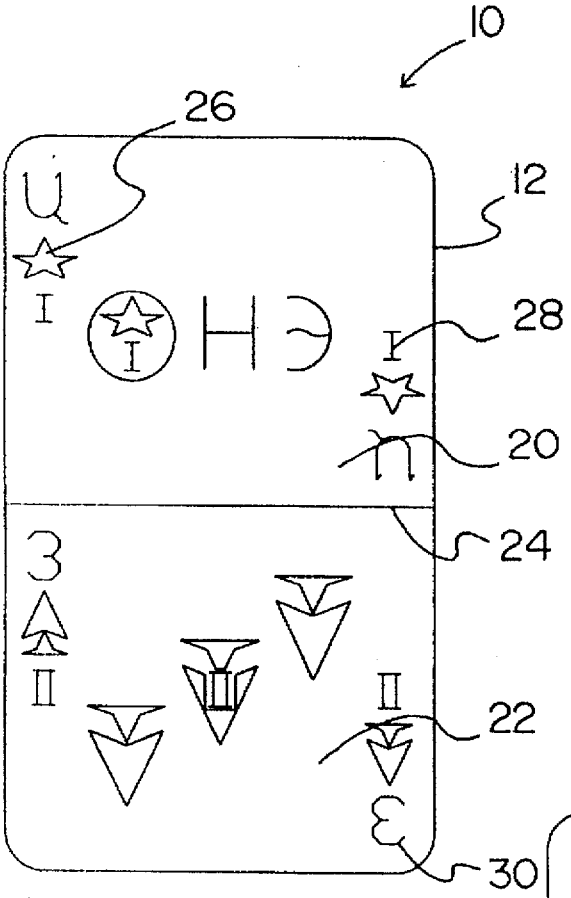
FIG. 1 discloses an example of the front side of a playing card illustrating the Armenian letter and number 1 on the first side of the card and three of trees on the second side of the card.
Figure 2:
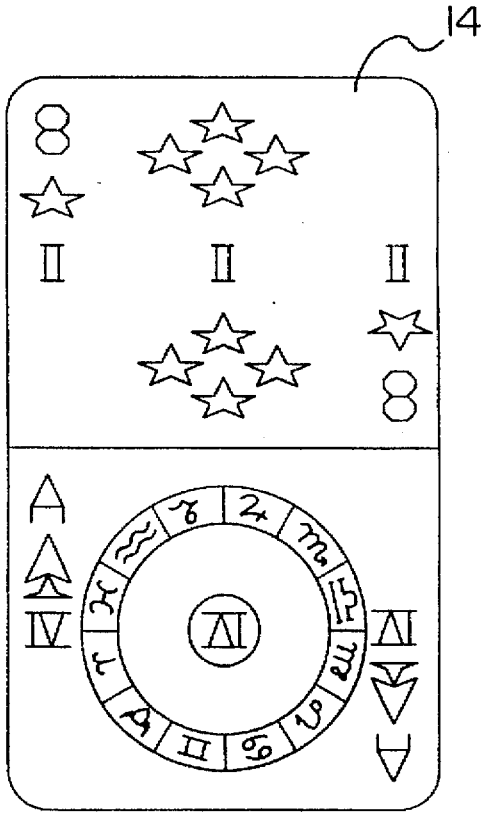
FIG. 2 discloses an example of the front side of a playing card illustrating eight of stars and on the first side of the card and an Astrologer's zodiac symbol on second side of the card.
Figure 3:
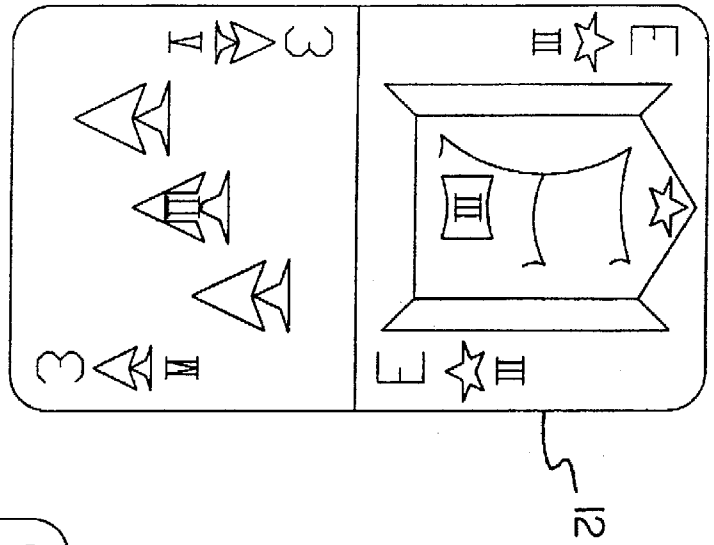
FIG. 3 discloses an example of the front side of a playing card illustrating the Empress symbol on the first side of the card and three of trees on the second side of the card.
Figure 4:
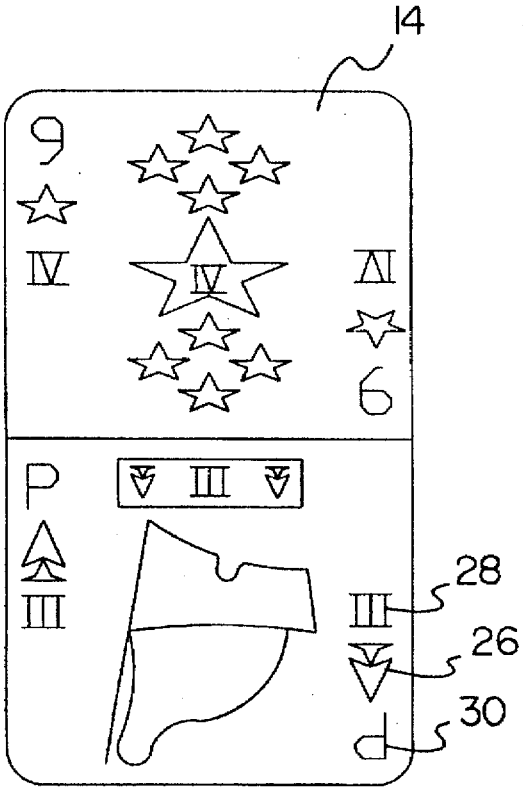
FIG. 4 discloses an example of the front side of a playing card illustrating nine of stars and on the first side of the card and a Pharaoh symbol on second side of the card.
Figure 5:
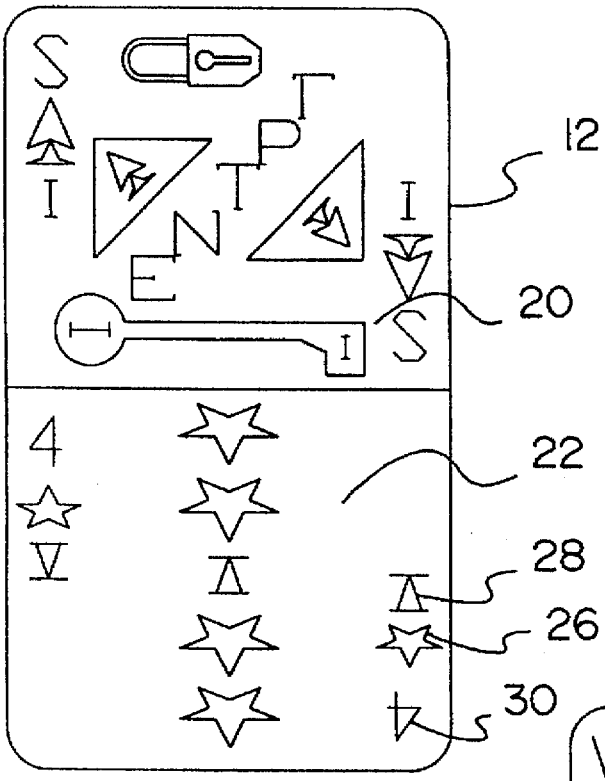
FIG. 5 discloses an example of the front side of a playing card illustrating the Sentry symbol on the first side of the card and four of stars on the second side of the card.
Figure 6:
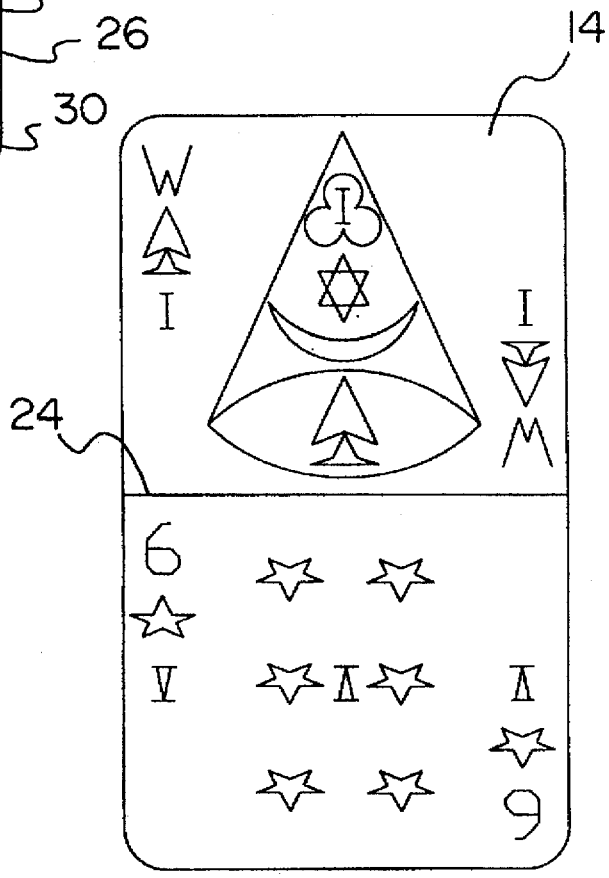
FIG. 6 discloses an example of the front side of a playing card illustrating Wizard's cap symbol on the first side of the card and a six of stars on the second side of the card.

With reference now to the drawings, and in particular, to FIG. 1 thereof, the preferred embodiment of the new and improved two faced poker card game embodying the principles and concepts of the present invention and generally designated by the reference number 10 will be described.

Specifically, it will be noted in the various Figures that the device relates to a plurality of cards. In its broadest context, the device consists of. Such components are individually configured and correlated with respect to each other so as to attain the desired objective.

Figures 7, 8:
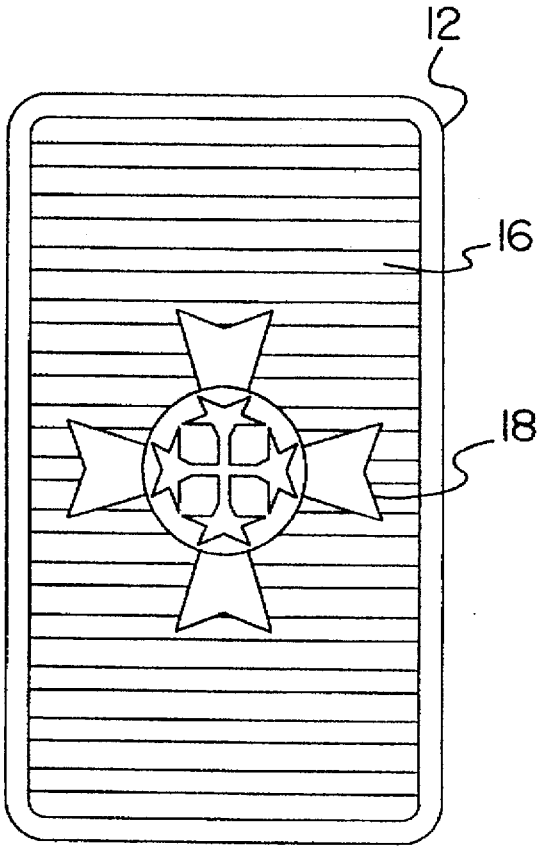
FIG. 7 discloses the design on the rear side of the playing cards.
FIG. 8 discloses a table illustrating the combinations of cards.

More specifically, it should be noted that the system 10 of the present invention includes a total of 70 rectangular cards 12 each with a top face 14, a bottom face 16, and a periphery defined by a pair of short edges and a pair of long edges. Each top face has a decorative pattern 18 formed thereon, as shown in FIG. 7. Each bottom face has a first section 20 and a second section 22 defined by a subdividing line 24 extending between a center of the long edges.

As shown in FIGS. 1–6, each section of each card includes a first indicia 26 situated in a central extent and diagonal corners thereof. As shown in each of the Figures, the first indicia of the first section of each card is dissimilar to the first indicia of the second section. It should be noted that the first indicia includes one of two different characters. Such characters include either a tree or a star.

Further printed on each section of each card is a second indicia 28. Similar to the first indicia, the second indicia is situated in a central extent and diagonal corners of each section. The second indicia of the first section of each card is dissimilar to the second indicia of the second section. The second indicia includes one of five different characters which include the following roman numerals: I, II, III, IV, V.

Finally, a third indicia 30 is situated in a central extent and diagonal corners of each section of each card. The third indicia of the first section of each card is dissimilar to the third indicia of the second section. Such third indicia includes the numerals 1–9 and 5 different face symbols. The face symbols may take the form of a sentry, astrologer, wizard, empress, or pharaoh. It should be noted that the third indicia includes one of 14 different characters.

Shown in FIG. 8 is a chart indicating the combination of characters of the first, second, and third indicia which are located on each of the cards. For example, it is indicated by the first row that there are 14 cards each with a first section having a "star" for a first indicia, "I" for a second indicia, and one of 14 different third indicia characters. Further indicated is that each of the 14 cards has a second section having a "tree" for a first indicia, "II" for a second indicia, and a one of 14 different third indicia characters corresponding to different third indicia characters of the first section.

During play, upon each player being dealt predetermined amount of cards, a plurality of different combinations of various predetermined rankings may be formed from the cards by selectively utilizing the first, second and third indicia of only one of the sections thereof. It should be noted that a winning player is defined as the player having the combination with the highest predetermined rank.

An example of rankings of the various combinations of cards is set forth below with the ranks descending from the first to last listed combination of cards:

| NAMES | FIRST INDICIA | SECOND INDICIA | THIRD INDICIA |
|---|---|---|---|
| MAGIC | 5 SAME | 5 CONSECUTIVE | 5 WIZARDS |
| HOLY FAMILY | 5 SAME | 5 SAME | ONE OF EACH |

-continued

| NAMES | FIRST INDICIA | SECOND INDICIA | THIRD INDICIA |
|---|---|---|---|
| REUNION | | | FACE SYMBOLS |
| GRAND FAMILY REUNION | 5 SAME | 5 SAME | 5 CONSECUTIVE |
| GRAND SENATE | 5 SAME | 5 CONSE-CUTIVE | 5 SAME |
| GRAND CARTEL | 4 SAME | MIXED | 4 SAME |
| GRAND CASTLE | 5 SAME | MIXED | 3 SAME & 2 SAME (Full House) |
| FAMILY REUNION | MIXED | 5 SAME | 5 CONSECUTIVE |
| SENATE | MIXED | MIXED | 5 SAME |
| CARTEL | MIXED | MIXED | 4 SAME |
| GRAND REUNION | 5 SAME | 5 SAME | MIXED |
| CASTLE | MIXED | MIXED | 3 SAME & 2 SAME (Full House) |
| GRAND FAMILY | 5 SAME | MIXED | 5 CONSECUTIVE |
| REUNION | MIXED | 5 SAME | MIXED |
| FAMILY | MIXED | MIXED | 5 CONSECUTIVE |
| GRAND TRINITY | 3 SAME | MIXED | 3 SAME |
| TRINITY | MIXED | MIXED | 3 SAME |
| GEMINI REUNION | MIXED | 4 SAME | 2 PAIR |
| GRAND GEMINI | 4 SAME | MIXED | 2 PAIR |
| GEMINI | MIXED | MIXED | 2 PAIR |
| TWIN REUNION | MIXED | 2 SAME | 2 SAME |
| GRAND TWINS | 2 SAME | MIXED | 2 SAME |
| TWINS | MIXED | MIXED | 2 SAME |
| HIGHEST CARD FACE | MIXED | HIGHEST | HIGHEST |

It should be noted that in a rank that requires the first, second, and/or third indicia of certain amount of cards to be similar, such requirements refer to the same group of cards. For example, in the Grand Trinity the 3 out of 5 cards that have the similar first indicia are the same 3 out of 5 cards that have similar second indicia. In addition, it should be understood that the use of the word "MIXED" in the forgoing table implies that the pertinent indicia of the set of 5 kind cards may be anything that doesn't define a higher rank when taken in combination with the other indicias. The requirement of the lowest ranked combination should be construed as allowing the second indicia to be the deciding factor in determining a winner. The third indicia is relied on only if the combinations of two players' hands have the same highest second indicia.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved two faced poker card game comprising, in combination:

a total of 70 rectangular cards each with a top face, a bottom face, and a periphery defined by a pair of short edges and a pair of long edges, wherein each top face has a decorative pattern formed thereon and each bottom face has a first section and a second section defined by a subdividing line extending between a center of the long edges, each section of each card including:

a first indicia situated in a central extent and diagonal corners thereof, wherein the first indicia of the first section of each card is dissimilar to the first indicia of the second section, wherein the first indicia includes one of two different characters, a second indicia situated in a central extent and diagonal corners thereof, wherein the second indicia of the first section of each card is dissimilar to the second indicia of the second section, wherein the second indicia includes one of five different characters, and a third indicia situated in a central extent and diagonal corners thereof, wherein the third indicia of the first section of each card is dissimilar to the third indicia of the second section, wherein the third indicia includes one of 14 different characters;

whereby upon each player being dealt a predetermined amount of cards, a plurality of different combinations of various predetermined rankings may be formed from the cards by selectively utilizing the first, second and third indicia of only one of the sections thereof, a winning player being defined as the player having the combination with the highest predetermined rank.

2. A two faced poker card game comprising:

a plurality of rectangular cards each with a top face, a bottom face, and a periphery, wherein each bottom face includes:

a first indicia including one of two different characters, a second indicia including one of five different characters, and a third indicia including one of 14 different characters;

wherein the bottom face of each card has a first section and a second section defined by a subdividing line, each section of each card having a first, second, and third indicia printed thereon, wherein the first, second, and third indicia of the first section are dissimilar to the corresponding first, second, and third indicia of the second section, respectively;

whereby upon each player being dealt a predetermined amount of cards, a plurality of different combinations of various predetermined rankings may be formed from the cards by selectively utilizing the first, second and third indicia thereof, a winning player being defined as the player having the combination with the highest predetermined rank.

3. A two faced poker card game as set forth in claim 2 wherein a total of 70 cards are included.

4. A new and improved method of playing a two faced poker card game comprising the steps of:

providing a total of 70 rectangular cards each with a top face, a bottom face, and a periphery defined by a pair of short edges and a pair of long edges, wherein each top face has a decorative pattern formed thereon and each bottom face has a first section and a second section defined by a subdividing line extending between a center of the long edges, each section of each card including:

a first indicia situated in a central extent and diagonal corners thereof, wherein the first indicia of the first section of each card is dissimilar to the first indicia of the second section, wherein the first indicia includes one of two different characters, a second indicia situated in a central extent and diagonal corners thereof, wherein the second indicia of the first section of each card is dissimilar to the second indicia of the second section, wherein the second indicia includes one of five different characters, and a third indicia situated in a central extent and diagonal corners thereof, wherein the third indicia of the first section of each card is dissimilar to the third indicia of the second section, wherein the third indicia includes one of 14 different characters;

dealing 5 of the cards to each of a plurality of players;

forming a plurality of different combinations of various predetermined rankings from the cards by selectively utilizing the first, second and third indicia;

forming a hand from the cards by each of the players, wherein only one section of each card may be utilized in the hand; and defining a winning player being as the player having a hand with the highest predetermined rank.

* * * * *